US006206646B1

(12) United States Patent
Bucher

(10) Patent No.: US 6,206,646 B1
(45) Date of Patent: Mar. 27, 2001

(54) METHOD AND SENSOR FOR THE DETECTION OF CAVITATIONS AND AN APPARATUS CONTAINING A SENSOR OF THIS KIND

(75) Inventor: Peter Bucher, Nuglar (CH)

(73) Assignee: NSB Gas Processing AG, Basel (CH)

( * ) Notice: Subject to any disclaimer, the term of this patent is extended or adjusted under 35 U.S.C. 154(b) by 0 days.

(21) Appl. No.: 09/270,958

(22) Filed: Mar. 17, 1999

(30) Foreign Application Priority Data

Mar. 19, 1998 (EP) ..... 98810237

(51) Int. Cl.[7] ..... F04B 49/00; F04C 19/00
(52) U.S. Cl. ..... 417/63; 417/68
(58) Field of Search ..... 417/63, 68, 53

(56) References Cited

U.S. PATENT DOCUMENTS

| | | | | |
|---|---|---|---|---|
| 4,608,833 | | 9/1986 | Kountz | 62/228.1 |
| 4,655,688 | * | 4/1987 | Bohn et al. | 417/68 |
| 4,692,101 | * | 9/1987 | Fink et al. | 417/68 |
| 4,850,805 | * | 7/1989 | Madsen et al. | 417/63 |
| 4,913,625 | * | 4/1990 | Gerlowski | 417/53 |
| 5,669,225 | * | 9/1997 | Beaverson et al. | 62/201 |

FOREIGN PATENT DOCUMENTS

| | | | |
|---|---|---|---|
| 3520734A1 | | 12/1986 | (DE) . |
| 3520734 | * | 12/1986 | (DE) . |
| 4300560A1 | | 7/1993 | (DE) . |
| 0321295A2 | | 6/1989 | (EP) . |
| 0742372A1 | | 11/1996 | (EP) . |
| 11-37979 | * | 2/1999 | (JP) . |

* cited by examiner

*Primary Examiner*—Charles G. Freay
*Assistant Examiner*—Michael K. Gray
(74) *Attorney, Agent, or Firm*—Townsend and Townsend and Crew LLP

(57) ABSTRACT

In a method for the detection of cavitations in a space to be monitored, the space to be monitored is monitored by means of a sensor (2) which is capable of learning. In this, a state in which cavitations arise in any case in the space to be monitored is first produced during a learning process for the duration of a first time interval (t1). After the completion of the first time interval (t1) a state in which cavitations do not arise in any case in the space to be monitored is produced for the duration of a second time interval (t2). In each of the two time intervals the sensor (2) learns which signals correspond to cavitations and which signals correspond to non-cavitations respectively in the space to be monitored. After the completion of this learning process the sensor compares the signals which arise during operation in the space to be monitored with the learned signals for cavitation and non-cavitation respectively and decides on this basis whether a cavitation has arisen in the space to be monitored or not and produces a corresponding output signal.

13 Claims, 3 Drawing Sheets

METHOD AND SENSOR FOR THE DETECTION OF CAVITATIONS AND AN APPARATUS CONTAINING A SENSOR OF THIS KIND

BACKGROUND OF THE INVENTION

The invention relates to a method and to a sensor for the detection of cavitations in accordance with the respective independent patent claim and to an apparatus containing a sensor of this kind.

By a cavitation one understands a sudden cavity formation such can arise for example when in liquid ring vacuum pumps—these are pumps which use a liquid as an auxiliary means for the production of a vacuum—the previously evaporated liquid condenses very rapidly or even abruptly. In liquid pumps of this kind a mechanical impact or striking on the blade or blades of the blade wheel between which the gas is located arises through a cavitation of this kind. This results in a more or less minor damage to the blades in each cavitation, through which the blade wheel and thus the pump becomes unusable with time.

Now it is often the case in industrial uses that the pumps are located at a place where they cannot be continually monitored without further ado as to whether and how often such cavitations arise. Moreover, the pumps also produce a certain operating noise during operation (even without cavitations occurring), which can at times be quite considerable, so that it can be difficult even in a monitoring of the pumps by the operating personnel to recognize whether and at what frequency such cavitations now arise.

Since on the other hand cavitations can lead to damage of the pump with time, as already explained above, such cavitations should be avoided or at least detected in order that corresponding measures can be taken (e.g. the operating parameters can be changed) in order to prevent a continuous arising of such cavitations.

SUMMARY OF THE INVENTION

In accordance with the invention a space to be monitored is monitored by means of a sensor which is capable of learning. In this, a state in which cavitations arise in any case in the space to be monitored is produced at least once (afterwards a save can be made) during a learning process for the duration of a first time interval. After the completion of the first time interval a state is produced for the duration of a second time interval in which cavitations do not in any case arise in the space to be monitored. In each of the two time intervals the sensor learns which signals correspond to cavitations and which signals correspond to non-cavitations respectively in the space to be monitored. After the completion of this learning process the sensor investigates the signals arising during operation in the space to be monitored as to whether predeterminable criteria, which are derived from the learned signals for the cavitations and non-cavitations respectively, have been fulfilled and decides on this basis whether a cavitation has arisen in the space to be monitored or not and produced a corresponding output signal. In this way the sensor can itself first "learn" what is a cavitation and what is not (in particular it naturally also gets to know the noise of the operation without cavitations) and then decides after a learning phase whether cavitations arise or not. The reliability of this is decidedly high. Thus the corresponding pump can be set up at a place where a continuous monitoring is not possible. If during the operation of the pump the sensor recognizes that cavitations arise it can trigger an alarm when appropriate so that the operating personnel can take corrective measures and damage to the blades and hence to the pump can be avoided.

A sensor which is designed as a pressure sensor can be used for this in an advantageous embodiment, and the pressure is monitored in the space to be monitored. Pressure sensors are available today in various embodiments and can directly deliver an output signal which represents the pressure. In principle, however, other sensors, such as for example acoustic sensors, also come under consideration.

In the space to be monitored the absolute pressure as well as the pressure change can be monitored, in particular, of course, both. This is especially advantageous for the learning process because the latter can then proceed as follows. In the learning process a pressure drop which is greater than a predeterminable minimum pressure drop can first be produced in the space to be monitored. Then when a predeterminable pressure at which cavitations arise in the space to be monitored in any case is reached or dropped below respectively, the sensor for the first time interval is triggered. The sensor now "learns" in this first time interval what a cavitation is. After the completion of the first time interval a pressure increase is produced again which is greater than or equal to a predeterminable minimum pressure increase and the sensor is triggered for the second time interval as soon as the minimum pressure increase is reached or exceeded and a predeterminable pressure is reached or exceeded. The sensor then "learns" in this second time interval what a "non-cavitation" is. After this learning phase the operation of the pump can then take place.

In a further development of this variant the sensor is not triggered in the learning process for the first time interval until the further drop in the pressure is less than a predeterminable threshold value. It is thus waited until the pressure drop is practically completed. After the end of the first time interval the sensor is triggered for the second time interval when the increase in pressure is greater than a predeterminable threshold value. Since the operation is preferably carried out at low vapor pressures, in the event of a correspondingly large pressure increase the pressure practically immediately lies above the vapor pressure (and in any case no cavitations arise).

In an advantageous embodiment variant of the method in accordance with the invention the sensor determines for different criteria how high the probability is when the respective criterion is fulfilled that a cavitation has arisen and that subsequently the sensor decides as a result of all criteria and the associated probabilities whether a cavitation has arisen or not and produces the corresponding output signal. Sensors of this kind typically use the principles of "fuzzy logic".

The object is also satisfied by means of a sensor which is capable of learning. In this a state in which cavitations arise in any case in the space to be monitored is first produced in the space to be monitored during a learning process for the duration of a first time interval. In this, first time interval the sensor learns what a cavitation is. After the completion of the first time interval a state in which cavitations do not arise in any case in the space to be monitored is produced in the space to be monitored for the duration of a second time interval. In this second time interval the sensor learns what a "non-cavitation" is. Now the sensor comprises means which in each of the two time intervals store the signals which correspond to the cavitations and the non-cavitations respectively in the space to be monitored. Furthermore, the sensor comprises means which investigate the signals arising in the space to be monitored during operation as to whether predeterminable criteria which are derived from the learned signals for the cavitation and the non-cavitation respectively are fulfilled as well as means which decide on this basis whether a cavitation has arisen or not in the space to be monitored and which then produce a corresponding output signal. With a sensor of this kind a pump can be monitored with high reliability, even when operating personnel cannot continually be on site. If cavitations arise, then an alarm can be triggered when appropriate as a result of the sensor output signal so that the operating personnel can take measures which prevent damage to the blades and hence to the pump.

In an advantageous exemplary embodiment the sensor has means for the determination of the pressure in the space to be monitored; it is thus executed as a pressure sensor. In a further development it has means for the determination of the pressure as well as the pressure change in the space to be monitored, in particular of both, which can especially be advantageous for the learning process. In this the change of the pressure can be determined either by means of forming differences between successive measured values of the absolute pressure, or separate means can be provided which enable a direct measurement of the pressure change.

In accordance with a further development the sensor has triggering means which trigger the sensor for the first time interval during the learning process when a pressure drop is produced in the space to be monitored which is greater than a predeterminable minimum pressure drop and when a predeterminable pressure at which cavitations arise in any case in the space to be monitored is reached or exceeded. In this first time interval the sensor then learns what a cavitation is and stores the corresponding signals. Furthermore, the sensor comprises means which after the completion of the first time interval trigger the sensor for the second time interval as soon as a pressure rise is produced which is greater than or equal to a predeterminable minimum pressure increase and as soon as a predeterminable minimum pressure is reached or exceeded. The sensor learns in this time interval what a non-cavitation is and stores the corresponding signals.

In a further development the means for the triggering of the sensor produce during the learning process a triggering of the sensor for the first time interval only when the further pressure drop is less than a predeterminable threshold value. In other words, this means that a triggering for the first time interval takes place at a practically stable low pressure. After the completion of the first time interval the means for triggering the sensor trigger the sensor for the second time interval when the pressure increase is greater than a predeterminable threshold value. Since the operation is preferably carried out at low vapor pressures, in the event of a correspondingly great pressure increase the pressure practically immediately lies above the vapor pressure.

In accordance with an exemplary embodiment of the invention the sensor comprises means which determine for different criteria how high the probability is when the respective criterion is fulfilled that a cavitation has arisen as well as means which subsequently decide as a result of all the criteria and the associated probabilities whether a cavitation has arisen or not and produce the corresponding output signal. Sensors of this kind typically use the principles of "fuzzy logic".

Finally, an apparatus, in particular a liquid ring pump, which comprises a corresponding sensor, is also a subject of the invention.

DESCRIPTION OF THE PREFERRED EMBODIMENTS

Figure 1:
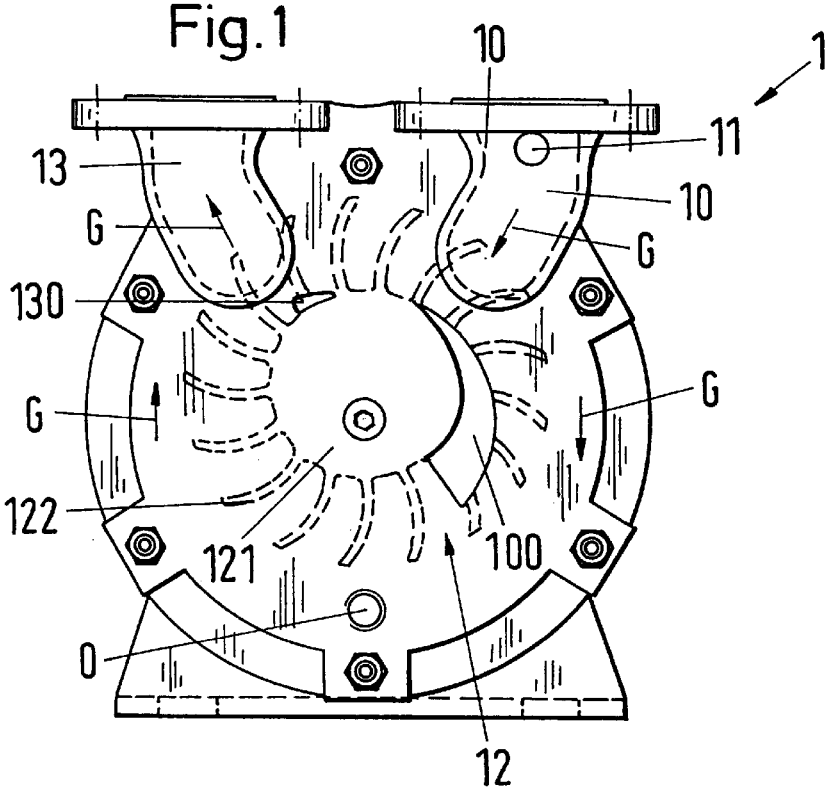
FIG. 1 is an exemplary embodiment of a liquid ring pump, constructed in accordance with the invention.

In the exemplary embodiment of a liquid ring pump 1 illustrated in FIG. 1 one recognizes its suck-in connector 10 and the location 11 at which a pressure transmitter of a cavitation sensor (not shown) can be arranged in the interior of the suck-in connector 10. Furthermore, one recognizes an eccentrically arranged blade wheel 12 (broken lines), with the help of which the gas to be forwarded (e.g. air in a vacuum pump) is sucked in through the suck-in connector 10 and the suck-in slit 100, which are in connection with one another, which can however not be recognizes in FIG. 1 for reasons of draftsmanship. The direction in which the gas is forwarded is indicated by the arrows G. It is immediately evident that for this the blade wheel 12 must be driven clockwise, which e.g. can be done by means of a (non-illustrated) electric motor. Furthermore, one also recognized in FIG. 1 an outlet slit 130 and an outlet connector 13, which are likewise in connection with one another, which can however not be recognized in FIG. 1 for reasons of draftsmanship. The gas can be conducted back out of the pump through the outlet slit 130.

Figure 2:
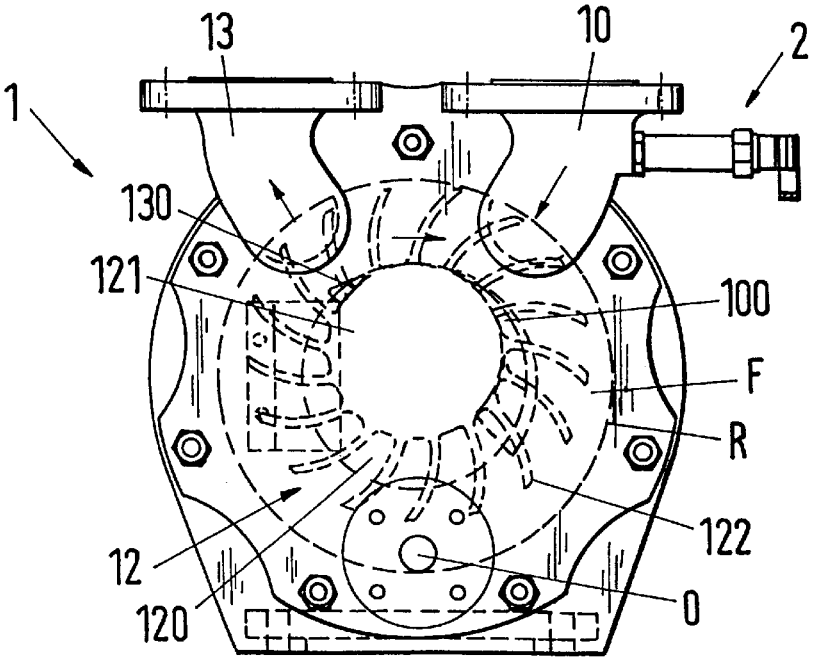
FIG. 2 is the exemplary embodiment in accordance with FIG. 1, with the liquid ring and the sensor for the detection of cavitations being recognizable.

FIG. 2 shows the exemplary embodiment of the liquid ring pump 1 in accordance with FIG. 1; however, the sensor 2 for the detection of cavitations can also be additionally recognizes at the suck-in connector 10. In addition the ring liquid space R can also be schematically recognized which is arranged concentrically to the pump housing and is filled with a liquid F, which is illustrated as hatching. The blade wheel 12 is arranged eccentrically with respect to this ring liquid space R. The suck-in slit 100 and the outlet slit 130 are also indicated in FIG. 2 in order to be better able to explain the method of functioning of a pump of this kind. Furthermore, an opening O for the liquid F is also indicated. New liquid F must namely—as will yet be explained—continuously be conducted in and warmed liquid F conveyed off.

The theoretical method of functioning of a pump of this kind, which can in particular be operated as a vacuum pump, is now as follows (see FIG. 2): Through the clockwise rotation of the blade wheel 12 the gas to be forwarded (in the case of the vacuum pump, e.g., the air from the space to be evacuated) is sucked in through the suck-in connector 10 and the suck-in slit 100 into the space 120 between the hub 121 and the blades 122 of the blade wheel. If the region of the suck-in slit 100 is brushed past, then the gas to be forwarded is enclosed in this space 120. Due to the eccentric arrangement of the blade wheel 12 with respect to the ring liquid space R, this space 120 becomes increasingly small in the upwards movement in the direction towards the outlet slit 130. The gas located in the space 120 is thereby compressed and heats itself as well as the liquid F. If the space 120 reaches the region of the outlet slit 130 then the compressed (heated) gas can escape through the outlet slit 130.

If now the pressure in the space 120 becomes lower than the vapor pressure of the liquid F, because practically no more air can be sucked in from the space to be evacuated, then the liquid F can evaporate into the space 120 during the increase of the volume of the space 120 in the downward movement of the blade wheel 12. If the gas is then compressed again during the upward movement, because the volume of the space 120 again decreases, then the gas condenses abruptly at the relatively cold surfaces of the blades 122 of the blade wheel 12 and the already mentioned cavitations occur. In vacuum operation, therefore, liquids with a low vapor pressure are chosen, because the quality of the vacuum is thereby improved.

The sensor 2 is provided for the detection of cavitations of this kind. Here it is a matter of a so-called sensor which is "capable of learning". This means that the sensor 2 is first taught in a learning process what actually corresponds (signal-wise) to a cavitation and what does not. For this a state must naturally be produced in which cavitations arise in any case. In this state the sensor 2 must "learn" what a cavitation is. The sensor 2 must also learn what a "non-cavitation" is in order that it is in the position to distinguish cavitations from other disturbance noises (such as e.g. flow noises, motor noises, etc.). This is done in a learning process such as is described in the following with reference to FIG. 3.

Figure 3:
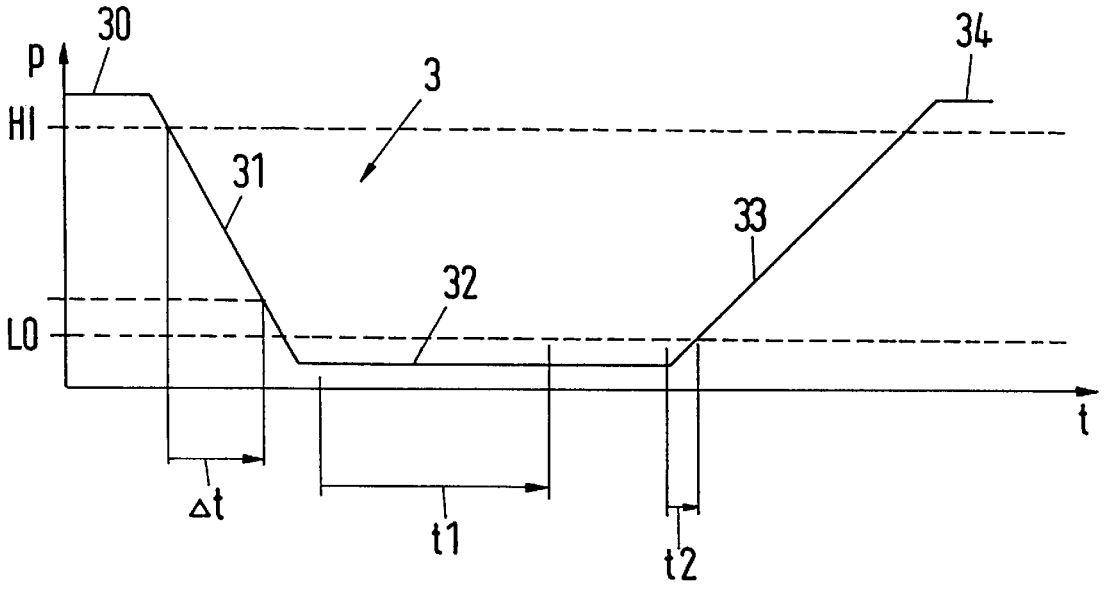
FIG. 3 is a typical plot of the absolute pressure (only the direct component) during the learning process of the sensor.

In FIG. 3 the plot of the absolute pressure p (direct component) is illustrated over the time t during the learning process in the form of a curve 3. This at first has a horizontal section 30 with a level HI; the pressure p (direct component) is thus substantially constant. Now a pressure drop is produced which corresponds to the descending flank 31 in the curve 3. If the sensor 2 detects a pressure drop of this kind which is greater than a predeterminable minimum pressure drop, which means that if the sensor 2 determines that the pressure p (direct component) falls by a value which is greater than a minimum pressure drop within a time interval $\Delta t$, it then knows that a time interval will now follow in which it will learn what "non-cavitations" are.

The triggering of the sensor 2 for the first time interval t1, in which the sensor learns what a cavitation is (signal-wise), now proceeds in such a manner that it is first waited until, on the one hand, the pressure level lies below LO and, on the other hand, the further pressure drop is less than a predeterminable threshold value. If the further pressure drop is less than this threshold value (this is the case in the region of the "bend" at the lower end of the flank 31, which strictly speaking is not a sharp bend, but a curved transition) then either a short, predetermined time can again be waited in addition or the triggering can take place immediately. The pressure p (direct component) is approximately constant in the region 32 which extends horizontally in FIG. 3 and cavitations (alternating component) occur at this pressure level in any case.

During the first time interval t1, means provided for this in the sensor 2 store the signals which correspond to the cavitations. In these signals it is a matter of the alternating part of the pressure (not shown in FIG. 3) which is recorded and stored for a determinable number of time windows, which all lie one after the other in the first time interval t1. In the recording and/or storing, for example, the signal components in the frequency range from 500–4000 Hz are taken into account.

If the first time interval t1 is completed, it is waited until again a minimum increase of the pressure p (direct component) takes place.

Since the operation is typically carried out at a low vapor pressure, the level of the pressure p (direct component) practically immediately lies again above the vapor pressure in the event of a predetermined minimum pressure increase and no further cavitations arise. When this minimum pressure increase has been detected, therefore, the sensor 2 is triggered for a second time interval t2. In this second time interval t2 no cavitations arise, and the means provided in the sensor 2 store the signals which correspond to a "non-cavitation".

After a renewed increase of the pressure via the flank 33 above the level HI the level of the pressure (direct component) again reaches the original value; the curve 3 therefore again extends horizontally in the region 34; the pressure (direct component) thus remains substantially constant. The learning process is thereby completed. The parameters for the recognition of which signals now correspond to a cavitation and which signals to a "non-cavitation" can then be stored so that no new learning by the sensor need take place when the operation is next resumed. Such a learning process can of course, however, also be carried out anew.

Figure 4:
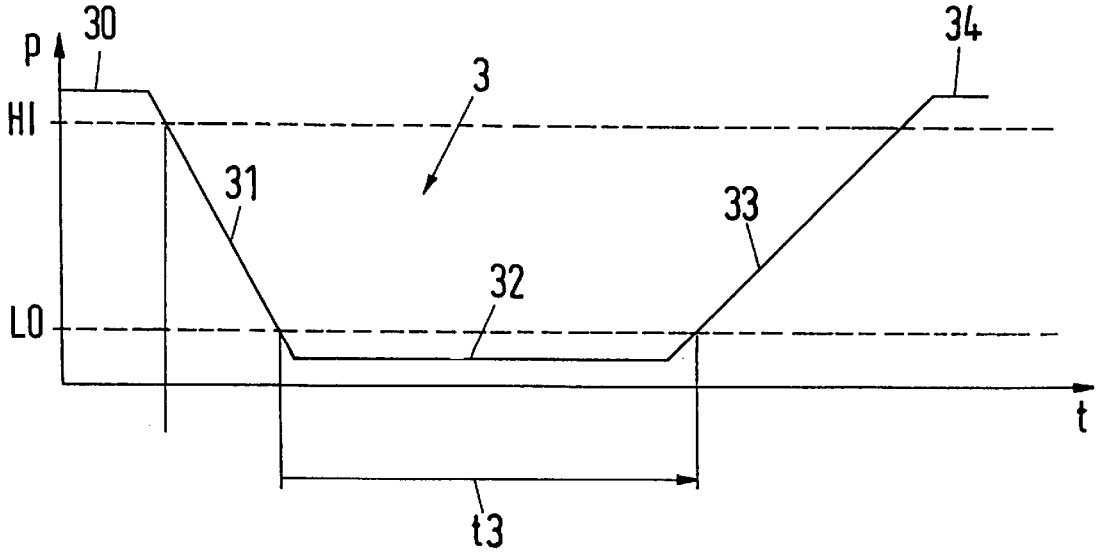
FIG. 4 is a plot of the absolute pressure of FIG. 1, with the triggering of the sensor during operation, that is, with a sensor which has learned.

In FIG. 4 the same signal plot as in FIG. 3 is shown, with however an operating state of the pump having been assumed here. For simplicity a plot of the pressure (direct component) is assumed which is similar to that in FIG. 3. The triggering of the sensor 2 takes place during operation only when the level of the pressure (direct component) lies below the level LO. This is a necessary—but not sufficient—condition for the arising of cavitations. If the sensor is triggered during the operation, then a monitoring with the help of the sensor 2 takes place for so long (time interval t3) until the level of the pressure (direct component) again lies above LO. If this is the case, cavitations can certainly not arise and the monitoring by the sensor is again discontinued until the level of the pressure (direct component) again falls below LO. The condition that the level of the pressure (direct component) lies below the level LO for triggering during operation is important insofar as disturbance noises (e.g. flow noises, motor noises, etc.), which could otherwise possibly be detected as a cavitation by the sensor, can also arise during normal operation, that is, in a level range of the pressure (direct component) in which certainly no cavitations can arise.

Figure 5:
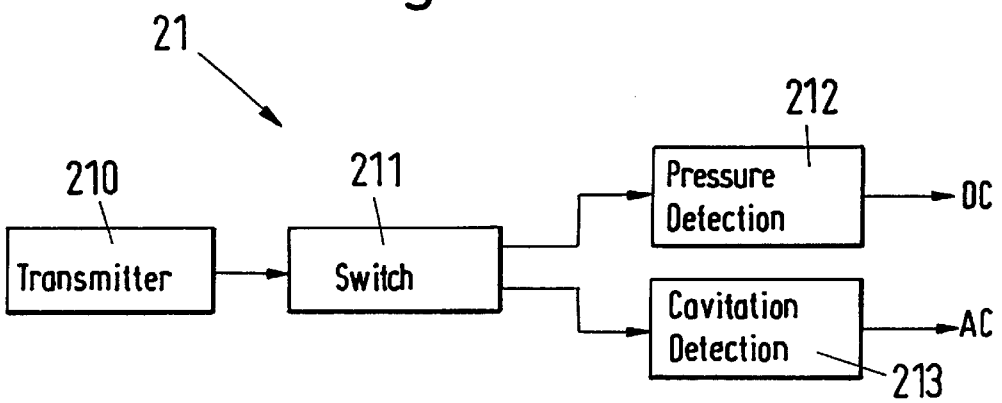
FIG. 5 is a block diagram of the signal generation unit of a sensor.

FIG. 5 shows a block diagram of a signal generation unit 21 of the sensor 2. There the separation of the signal delivered by a transmitter 210 takes place in a switch 211. The two output signal branches for the absolute pressure detection 212 and for the cavitation detection 213 follow on the outputs of the switch 211. In the absolute pressure detection 212 the direct component of the pressure is taken into account, whereas in the cavitation detection 213 the alternating part of the pressure is taken into account, for example in the already named frequency range of 500–4000 Hz.

Figure 6:
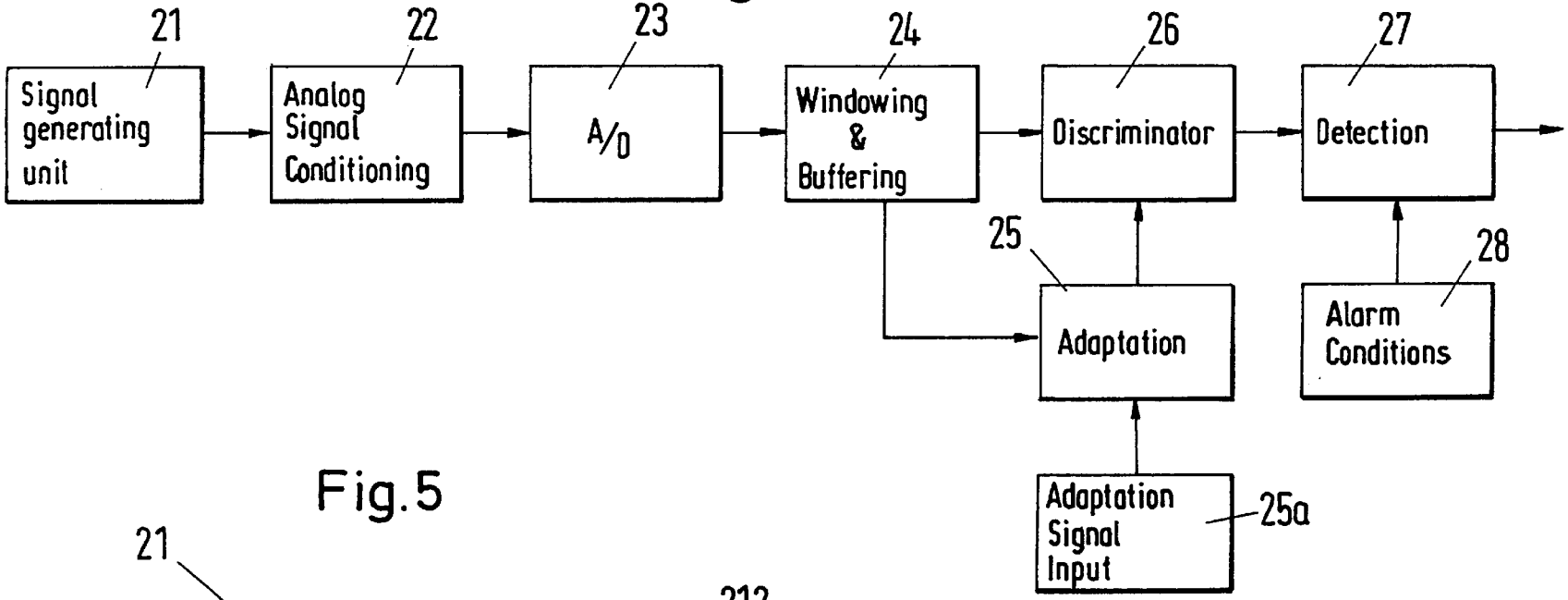
FIG. 6 is a block diagram of the manner of the signal evaluation in the sensor.

In FIG. 6, finally, the method of functioning of the signal processing in the sensor 2 is shown in a block diagram. The continuous signal which arrives from the signal generation unit 21 (see FIG. 5) is conditioned in a signal conditioning stage ("analog signal conditioning") 22 and is subsequently fed to an analog/digital (A/D) converter 23. Its output signals arrive at a windowing and buffering stage 24 in which the duration and the number of the time windows are determined in which the output signal of the A/D converter is actually stored and further processed. Influence can be taken on the discriminator stage 26 which is connected after the windowing and buffering stage 24 via an adaptation stage 25 and an associated adaptation signal input unit 25*a*.

In this discriminator stage 26 it is determined for different criteria how high the probability is when the respective criterion is fulfilled that a cavitation has arisen. Criteria of this kind can but need not exclusively be:

The number of tangents with a slope which is greater than a predetermined minimum slope The absolute value of the tangent steepness The amplitude of the fluctuations of the pressure level (alternating part).

In the detection stage 27, finally, a total evaluation of all criteria and of the associated probabilities respectively takes place. In this a different weight can be assigned to the individual criteria. The total evaluation of all criteria and of the associated probabilities finally leads to a total probability which, after a comparison with the data of an alarm conditions stage 28, leads either to an alarm being triggered by the detection stage 27 or not. Signal evaluations of this kind, in which a certain event has occurred with certain probabilities on the fulfillment of individual criteria, are typically based on the principles of "fuzzy logic".

As has already been mentioned, an apparatus of this kind is particularly suitable for use as a vacuum pump. The quality of the vacuum that can be achieved is determined in this by the vapor pressure of the liquid F in the liquid chamber F. It should also be mentioned here that the apparatus is naturally also suitable for uses in which a danger of explosion is present in the space to be monitored. In such a case the sensor can be executed in such a manner that the pressure transmitter is arranged in the region of the danger of explosion, but the rest of the sensor is outside the region of the danger of explosion. This can be of particular interest especially for use in the chemical/pharmaceutical industry.

What is claimed is:

1. A method for detecting fluid cavitations that may occur in a space that is being monitored and where first signals are being generated by the cavitations and second signals result from events other than the cavitations, the method comprising the steps of providing a sensor which is capable of learning; coupling the sensor and the space so that the sensor can pick up the signals; subjecting the sensor to a learning phase by producing cavitations in the space over a first time interval to thereby generate first signals, sensing the first signals with the sensor, thereafter discontinuing producing the cavitations in the space over a second time interval, and sensing the second signals with the sensor, whereby during the first and second time intervals the sensor learns to differentiate between first signals caused by cavitations and second signals caused by events other than cavitations; storing characteristics of the first and second signals sensed by the sensor following the learning phase; operating the space in a normal manner during which second signals are produced and first signal producing cavitations may occur; detecting the signals produced during the normal operation of the space; analyzing the detected signals with reference to the stored characteristics of the first and second signals to determine if given signals emanating in the space are first signals; and emitting an output signal which indicates if the given signals emanating from the space are first signals.

2. A method according to claim 1 wherein the step of providing the sensor comprises providing a pressure sensor, and wherein the sensing steps comprise sensing pressure in the space.

3. A method according to claim 2 wherein the step of sensing pressure comprises sensing absolute pressure and pressure changes in the space.

4. A method according to claim 7 wherein the step of subjecting the sensor to a learning phase comprises initially generating a pressure drop in the space which is greater than a predetermined minimum pressure drop; thereafter further dropping the pressure in the space and triggering the sensor for the first time interval after the pressure in the space reaches or is below a predetermined pressure at which cavitations will occur in the space; thereafter increasing the pressure in the space to where it is equal to or greater than a predetermined minimum pressure increase in the space; and triggering the sensor for the second time interval when the predetermined minimum pressure increase has been reached or exceeded and the pressure in the space has reached or exceeds a predetermined pressure at which cavitations will not occur in the space.

5. A method according to claim 4 wherein the sensor is triggered for the first time interval only after the pressure drop during the further dropping step is less than a predetermined threshold value, and wherein triggering the sensor for the second time interval takes place after the pressure in the space has increased by a predetermined threshold value.

6. A method according to claim 1 determining a probability that characteristics of first signals sensed during normal operation are in fact the result of cavitations occurring in the space, and wherein the emitting step includes considering the probability that the first signals were in fact the result of cavitations occurring in the space.

7. A sensor capable of learning for detecting fluid cavitations that may occur in a space that is being monitored, the space being initially subjected to a first state in which cavitations occur over a first time interval and a second state in which no cavitations occur over a second time interval during a learning phase for the sensor, the sensor comprising means for sensing and storing first and second signals respectively generated during the first and second time intervals, the first and second signals containing characteristics that reflect if a given signal was generated by cavitations occurring in the space or by events other than cavitations; means operative during normal operation of the space for investigating first and second operating signals generated during the normal operation of the space for determining if the operating signals have the characteristics of signals generated by cavitations occurring in the space; and means responsive to the investigating means for deciding if cavitations occurred in the space and for generating a corresponding output signal.

8. A sensor according to claim 7 including means for determining the pressure in the space.

9. A sensor according to claim 8 wherein the means for determining the pressure in the space includes means for monitoring pressure changes in the space.

10. A sensor according to claim 9 including means for triggering the sensor for the first time interval during the learning phase after pressure in the space has dropped by more than a predetermined minimum pressure drop and the pressure in the space has reached or dropped below a pressure at which cavitations will occur in the space, and for triggering the sensor for the second time interval following the first time interval as soon as the pressure in the space has increased by an amount equal to or greater than a predetermined minimum pressure increase and a predetermined minimum pressure in the space has been exceeded.

11. A sensor according to claim 10 wherein the triggering means triggers the sensor for the first time interval only after there is a further pressure drop in the space which is less than a predetermined threshold value, and wherein the triggering means further triggers the sensor for the second time interval following the first time interval after the pressure increase in the space is greater than a predetermined threshold value.

12. A sensor according to claim 10 including means for determining a probability that characteristics sensed during normal operations are in fact the result of cavitations occurring in the space, and wherein the means for deciding takes into account the probability that the first signals were in fact the result of cavitations occurring in the space.

13. A liquid ring pump comprising a sensor capable of learning for detecting fluid cavitations that may occur in a space of the pump that is being monitored, the space being initially subjected to a first state in which cavitations occur over a first time interval and a second state in which no cavitations occur over a second time interval during a learning phase for the sensor, the sensor comprising means for sensing and storing first and second signals respectively generated during the first and second time intervals, the first and second signals containing characteristics that reflect if a given signal was generated by cavitations occurring in the space or by events other than cavitations; means operative during normal operation of the pump for investigating first and second operating signals generated during the normal operation of the pump for determining if the operating signals have the characteristics of signals generated by cavitations occurring in the space; and means responsive to the investigating means for deciding if cavitations occurred in the space and for generating a corresponding output signal.

* * * * *